United States Patent [19]

Beauchamp et al.

[11] 4,228,980

[45] Oct. 21, 1980

[54] VALANCE HANGER BRACKET AND SYSTEM

[76] Inventors: Pierre Beauchamp, 3187 St. Charles St., St. Laurent, Canada, H4R 1B5; Augusto Di Giacomo, 9338 Bruchési, Montreal, Canada, H1Z 2P7

[21] Appl. No.: 959,333

[22] Filed: Nov. 9, 1978

[51] Int. Cl.[2] ..... A47H 1/10

[52] U.S. Cl. ..... 248/262; 5/493; 160/330; 16/87.2

[58] Field of Search ..... 5/333, 353.2, 353.5, 5/353.6; 16/87.2; 160/327–330, 341, 342, 345; 248/262, 301, 305, 339

[56] References Cited

U.S. PATENT DOCUMENTS

| | | | |
|---|---|---|---|
| 710,477 | 10/1902 | Littell | 16/87.2 UX |
| 856,454 | 6/1907 | Evans | 160/395 X |
| 1,119,695 | 12/1914 | Hatch | 248/261 |
| 2,198,280 | 4/1940 | Culbertson | 248/252 |
| 2,286,118 | 6/1942 | Sleeth | 248/301 X |
| 2,811,328 | 10/1957 | Ericson | 248/301 X |
| 2,891,752 | 6/1959 | Genter | 248/304 X |
| 3,836,107 | 9/1974 | Barry | 248/251 |
| 3,865,336 | 2/1975 | Robertson | 211/123 X |
| 3,959,854 | 6/1976 | Lewis | 5/333 X |

FOREIGN PATENT DOCUMENTS

| | | | |
|---|---|---|---|
| 1902 | of 1903 | United Kingdom | 5/333 |
| 20213 | of 1913 | United Kingdom | 5/333 |
| 1278118 | 6/1972 | United Kingdom | 248/301 |

*Primary Examiner*—James C. Mitchell

[57] ABSTRACT

A bracket and a system adapted to hang a curtain and, in particular, a valance to advantageously provide for easy and neat installation, to effectively conceal the head and the space at the top of a curtain and to even conceal the bracket itself. This bracket is formed of a resilient strip bent to define a hook portion and a fixing portion with the hook portion having a pair of spaced-apart upright portions and the fixing portion outwardly projecting from the upper end of one upright portion away from the other upright portion to be fixed to a ceiling. This curtain hanger system includes a flat bar securable lengthwise along the head of a curtain or valence and one or more of the defined brackets, such that the flat bar operatively engages laterally edgewise between the upright portions to be clamped by the latter with its upper edge bearing against the ceiling.

4 Claims, 3 Drawing Figures

VALANCE HANGER BRACKET AND SYSTEM

This invention relates to curtain hangers and, in particular, to a bracket and a system of the type adapted to hang a curtain.

The system and brackets so far used to hang a valance are not found very satisfactory, since they are not effective to fully conceal the head and space at the top of a curtain and the brackets for the valance. Besides, the brackets used so far make it hard to quickly and neatly install a curtain and, in particular, a valance due, for instance, to interference of these prior art brackets with the curtain rod, the curtain material and/or the hooks of the curtain rod.

It is a general object of the present invention to provide a curtain hanger bracket and a curtain hanger system which obviate the above-mentioned disadvantages and which are suitable for any curtain and are of particular advantage for a valance.

It is another general object of the present invention to provide a curtain hanger system of the above type which effectively conceals the supporting brackets and does not leave any gap between the head of the curtain or valance and the associated ceiling.

It is another object of the present invention to provide a curtain hanger bracket and a curtain hanger system operatively used in combination with a curtain hanger bar wherein a hook portion of the bracket is adapted to merely rest the bar therein and firmly hold the latter against falling off under downward pull by the curtain.

It is a more specific object of the present invention to provide a curtain hanger bracket and a curtain hanger system wherein the bracket is particularly adapted to take advantage of the overlying ceiling to bias the curtain hanger bar in operative position in the hook portion of the bracket.

It is still another object of the present invention to provide a curtain hanger bracket and a curtain hanger system operatively used in combination with a curtain hanger bar and wherein the bracket is adapted to avoid the formation of any false fold by the bracket along the head of the curtain.

The above and other objects and advantages of the present invention will be better understood with the following detailed description of a preferred embodiment thereof which are illustrated, by way of example, in the accompanying drawings, in which.

Figure 1:
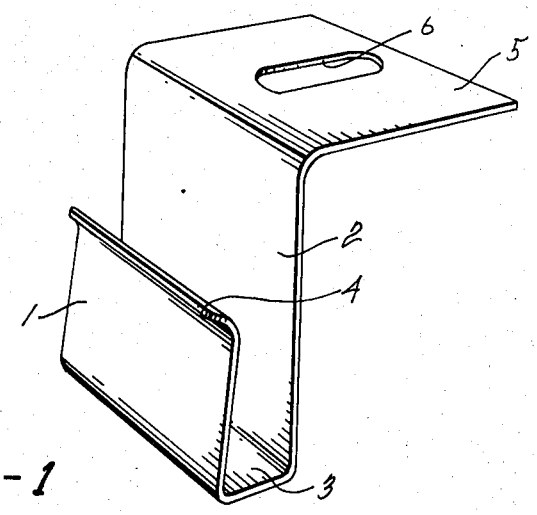
FIG. 1 is a perspective view of a curtain hanger bracket according to the present invention.

The illustrated curtain hanger bracket includes a hook portion and a fixing portion. The hook portion has a generally U-shape configuration when seen in side elevation as in FIGS. 2 and 3. The hook portion includes a front and a rear upright portions 1 and 2 separated by a bottom intermediate portion 3. The two upright portions 1 and 2 are arranged in predetermined spaced-apart relationship. The free upper end or edge portion 4 of the front upright portion 1 is curved outwardly away from the rear upright portion 2. This upper end portion 4 terminates short of the upper end of the rear upright portion 2 to leave a gap above this upper end. The front upright portion 1 operatively extends to a height greater than the height of the rear upright portion above the front upright portion.

As shown in the drawings, the front and the rear upright portions 1 and 2 upwardly converge toward each other and consequently are closer to each other at the upper end portion 4 than at the lower end of the front upright portion. In fact, the rear upright portion 2 is flat or planar and the front upright portion converges toward the rear upright portion.

The fixing portion is formed of a flat portion 5 projecting from the upper end of the rear upright portion 2 and substantially orthogonally to the latter away from the front upright portion. A slot 6 is provided in the fixing portion 5 and extends in the front to rear direction relative to the bracket.

The above described bracket is wholly made of a single strip of resilient and flexible material, such as metal or plastic, which is bent such that transverse bends separate the above-mentioned upright portions, intermediate portion, and fixing portion one from another. The planar or flat rear upright portion forms a substantially right angle corner with the intermediate portion 3.

The curtain hanger system of the present invention includes a flat curtain hanger bar 7 around which the valance or curtain 10 is secured. The flat bar 7 is of predetermined width in relation to the bracket such that the overall width of the bar with the curtain 10 secured to it slightly exceeds the effective height between the transverse portion 3 at the bottom of the hook portion and the ceiling. Thus, when the flat bar 7 is engaged in operative position in the hook portion, the upper edge of the bar abuts against the ceiling and rearwardly flexes the rear upright portion 2 and in effect the whole hook portion of the bracket. Thus, bar 7 is frictionally engaged at its upper edge against the ceiling 9. The flat bar 7 is of predetermined thickness slightly exceeding the minimum gap space between the front and the rear upright portions 1 and 2. Thus, when the flat bar is operatively engaged in the hook portion, the resilient clamping engagement by the front upright portion 1 rearwardly biases the flat bar which then squarely fits in the aforementioned corner, as shown in FIG. 2, to thus further enhance firm retention of the bar in the hook portion, in cooperation with the aforementioned predetermined height of the front upright portion and also in cooperation with the frictional engagement of the upper edge of the bar with the ceiling.

Figure 2:
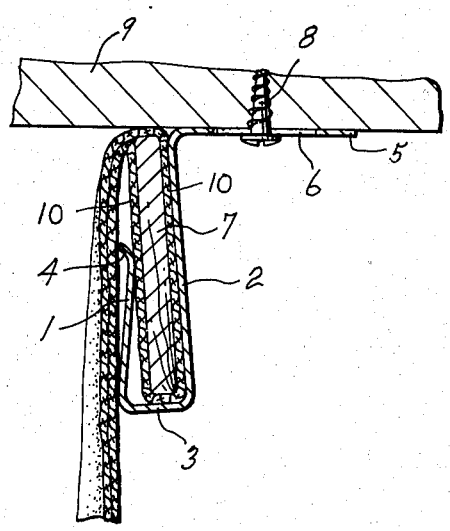
FIG. 2 is a transverse cross-section through a valance installation with a curtain hanger system according to the present invention.
Figure 3:
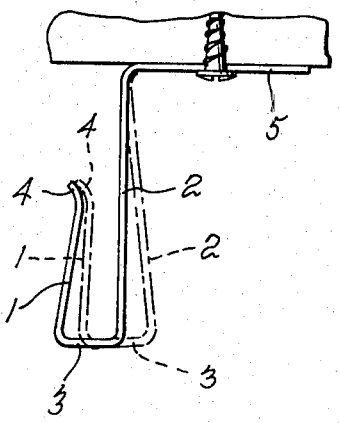
FIG. 3 is a side view of a curtain hanger bracket showing the inoperative and operative positions thereof in full lines and dashed lines respectively.

It must be noted that the upper edge 4 of the front upright portion 1 in the operative position stands in wholly inwardly retracted position relative to the lower edge of the front upright portion, as seen in FIGS. 2 and 3, thereby avoiding the making of a false fold by the upper edge 4 lengthwise of the head of the curtain 10.

Although two or more curtain hanger brackets are preferably used to support the curtain hanger 7 and the curtain 10, since the bar is biased against the ceiling which thus holds the equilibrium thereof, only one curtain hanger bracket may be used. A screw 8 adjustably secures each bracket against the ceiling 9.

After the flat bar 7 has been inserted lengthwise in a gusset formed at the head or top of the curtain, it is engaged edgewise in the gap between the curved edge portion 4 of each bracket and the ceiling. The flexibility and resilience of the bracket allow insertion of the flat bar 7 by outwardly bending the front upright portion 1.

As seen in FIG. 2, the flat bar 7 is clamped flat against the front face of the rear upright portion 2 and the valance or curtain hangs from the upper edge of the flat bar, and thus effectively hangs from right against the ceiling. Therefore, the valance or curtain effectively conceals all the curtain hanger brackets and the bar.

Even if the curtain is heavy, the bar 7 will not tip over because it is frictionally held against the ceiling 9, by the bias exerted by the fixed rear upright portion because of the predetermined height of the front upright portion relative to the height of the rear upright portion.

In operative position, the curtain hangs loosely in front of the curved edge portion 4 due to the operatively forward inclined position of the bar which brings the upper edge thereof in substantially overlying relationship relative to the inwardly retracted edge portion 4.

FIG. 3 illustrates in full lines the inoperative position of the bracket and in dashed lines the operative and rearwardly biased position of the bracket.

This system and, in particular, this bracket allows a lot of versatility or flexibility in the arrangements of a valance. For instance, an installation is made with a row of brackets aligned and laterally spaced apart in the intended direction of the valance. Each bracket is fixed to the ceiling by a screw and operatively supports the whole of a valance panel. These valance panels are staggered in any desired valance arrangement by placing any panel forward relative to another such that any forward panel partially overlaps a rearward panel. This selected rearward and forward positioning of the separate valance panels is done by unscrewing the corresponding bracket and adjusting it either forward or rearward relative to the aligned row of screws. This great versatility in the arrangement of valance panels is made possible by the brackets having each a slot 6 for fore and aft adjustment and by the hook portion of each bracket which is such as to firmly hold the bar against the ceiling such that a single bracket only is required to very positively and squarely support a valance panel.

What we claim is:

1. A curtain hanger system comprising, in combination, a ceiling, a curtain hanger bracket, a flat curtain hanger and a curtain or valance having a gusset at one edge portion, in which said flat bar is longitudinaly inserted and constituting a bar and gusset assembly, said curtain hanger bracket including a hook portion and a fixing portion integrally formed of a strip of resilient material, the hook portion having a transverse U-shape configuration including a transverse bottom portion and a front and a rear upright portion extending from the respective ends of said bottom portion, said fixing portion extending rearwardly from the upper end of said rear upright portion and at substantially right angle to said rear upright portion, said fixing portion being flat and fixed flat to said ceiling, said front upright portion being shorter than said rear upright portion and leaving between said ceiling and the upper end of said front upright portion a gap through which said bar and gusset assembly is inserted edgewise into said hook portion, said bar having a width slightly greater than the vertical distance between said ceiling and said bottom portion, said bar and gusset assembly inserted edgewise in said hook portion and having a lower edge resting on said bottom portion and a top edge bearing against said ceiling, said rear upright portion flexed rearwardly relative to said fixing portion, thereby inclined downwardly and rearwardly and biasing said bar and gusset assembly against said ceiling, said curtain or valance depending from the top edge of said bar and gusset assembly in front of said front upright portion and concealing said bracket.

2. A curtain hanger system as defined in claim 1, wherein said back upright portion is straight, the upper end of said front upright portion is outwardly curved away from said back upright portion to facilitate edgewise insertion of said bar and gusset assembly into said hook portion, said front and back upright portions upwardly converging, said bar having a thickness slightly exceeding the horizontal gap between said back upright portion and said upper end of said front upright portion, the upper end of said front upright portion biasing said bar and gusset assembly flat against said back upright portion in downwardly and rearwardly inclined position, the outwardly curved upper end of said front upright portion clearing the curtain or valance extending in front of the same.

3. A curtain hanger system as defined in claim 1 or 2, wherein said fixing portion has a slot extending longitudinally thereof.

4. A curtain hanger system as defined in claim 1 or 2, wherein said bottom portion is substantially perpendicular to said back upright portion.

* * * * *